United States Patent [19]

Ferenzi

[11] Patent Number: 4,726,475

[45] Date of Patent: Feb. 23, 1988

[54] DISH DRAIN BASKET WITH EXTENDABLE SIDES

[76] Inventor: Benedict W. Ferenzi, 4137 W. 77th Pl., Chicago, Ill. 60652

[21] Appl. No.: 35,364

[22] Filed: Apr. 7, 1987

[51] Int. Cl.[4] ..... A47F 3/14

[52] U.S. Cl. ..... 211/126; 211/41; 220/19

[58] Field of Search ..... 211/41, 181, 126, 201, 211/195; 220/19

[56] References Cited

U.S. PATENT DOCUMENTS 2,655,267 10/1953 Planeta ..... 211/41 X 2,708,037 5/1955 Planeta ..... 211/41 X

*Primary Examiner*—Ramon S. Britts

*Assistant Examiner*—Blair M. Johnson

[57] ABSTRACT

A standard type-dish drain basket defined by a bottom and four sides. This standard drain basket has been adapted to accommodate the invention, for contiguous, but independent extendable and retractable sides. Each contiguous side is constructed with a plurality of tines which are fashioned with a lower hook configuation for positioning the movable sides in the extended position. These tines are also fashioned with an upper hook configuration for positioning the movable sides in the retracted position. At the base of each tine is a loop configuration that joins each tine with the connecting rod. Each loop configuration encircles a fixed tine of the standard drain basket and uses these fixed tines as guideposts on which the contiguous, movable sides move up and down. The connecting rod connects each tine, stabilizing and completing the contiguous side.

2 Claims, 7 Drawing Figures

DISH DRAIN BASKET WITH EXTENDABLE SIDES

FIELD OF THE INVENTION

The present invention relates generally to a standard type dish drain basket and, more particularly, to a dish drain basket with four contiguous, but independently extendable and retractable sides.

BACKGROUND OF THE INVENTION

Typically, a dish drain basket allows for the placement of just washed dishes, pots, glasses and cups to drain. The main shortcoming of such prior art dish drain baskets is their limitation in size, which is mainly restricted because of the available space on counter tops and in double bowl sinks in which many drain baskets are placed.

As a result, it has remained necessary to provide a means for accommodating more dishes, pots, glasses and cups in the drain basket, but yet maintaining its original size to allow for its continued placement in one bowl of a double bowl sink.

The present invention is directed at overcoming the above stated problem and accomplishing the stated objective by providing a drain basket with four contiguous, but independently extendable and retractable sides.

SUMMARY OF THE INVENTION

Accordingly, the present invention is directed to a standard type dish drain basket made of wire or plastic with a bottom and four sides. The standard drain basket has been adapted for accommodating four contiguous, but independently extendable and retractable sides. Each side is constructed with a plurality of tines which are fashioned into a lower hook configuration for positioning this independent side in the extended position to allow for the placement of glasses and cups to drain. These tines are also fashioned with a second hook configuration, at their top, for positioning this independent side in the retracted position when not needed. When all four independent sides are extended they have the effect of doubling the depth of the drain basket allowing for the stacking of more dishes and pots. In addition, the placement of cups and glasses on the tines on all four sides, rather than in the basket, facilitates the stacking of many more dishes and pots.

BRIEF DESCRIPTION OF THE DRAWING

Because of the difficulty in making a drawing showing a dish drain basket with four extendable sides, the drawing has been simplified to show only one side of the dish drain basket having an extendable side.

DETAILED DESCRIPTION OF THE PREFERRED EMBODIMENT

Figure 1:
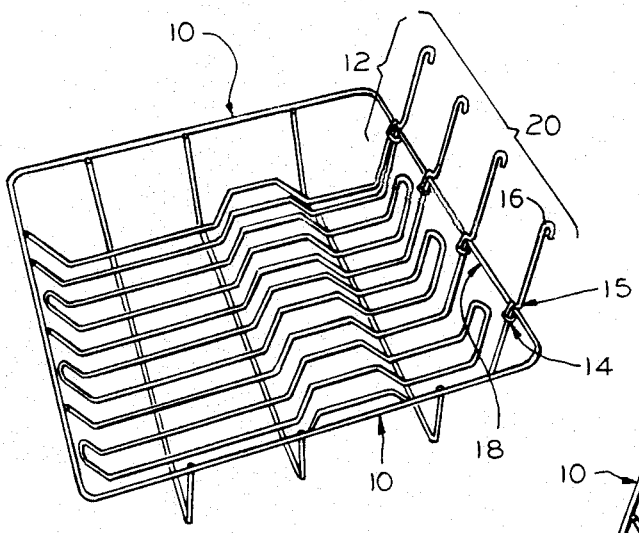
FIG. 1 is a perspective view showing the dish drain basket with only one extendable side in the extended position.

Referring to FIG. 1, number 10 indicates the embodiment of a typical dish drain basket showing just one of the four contiguous, but independently extendable and retractable sides 20 that are the actual invention. Only one side 20 of the invention is shown because of the difficulty in drawing all four sides 20.

Figure 3:
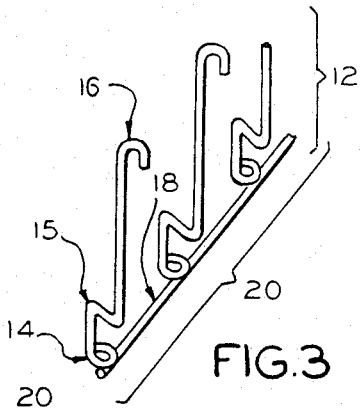
FIG. 3 is a perspective view of the extendable side independent of the drain basket.
Figure 2:
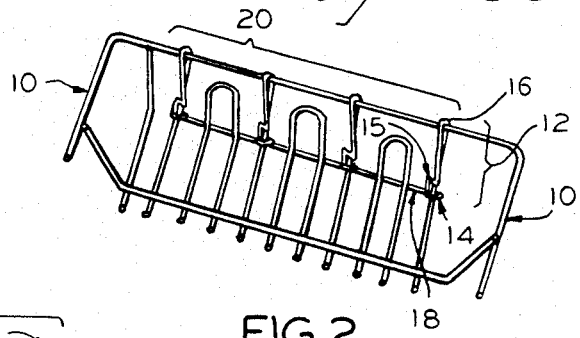
FIG. 2 is an overhead view showing one side of the dish drain basket with the extendable side in the retracted position.
Figure 4:
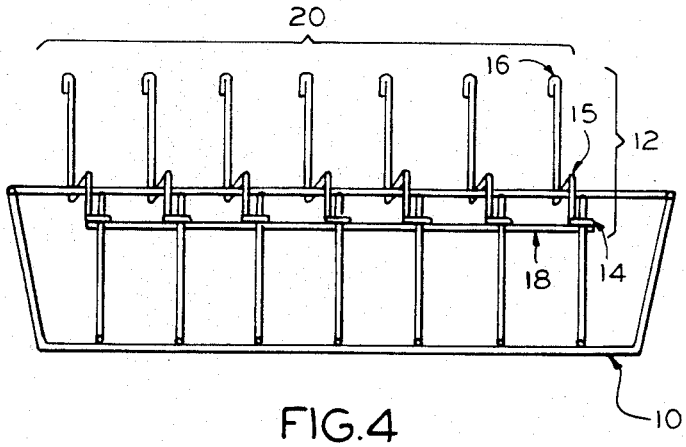
FIG. 4 is a level view from inside the drain basket looking out, with the extendable side hooked in the extended position.
Figure 5:
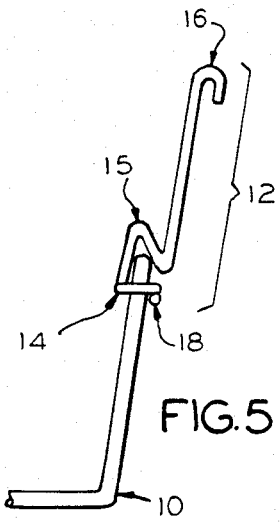
FIG. 5 is a perspective view of one of the end tines of an extendable side in the extended position which shows the function of the lower hook configuration and also shows the bottom loop configuration and its function as a guide that travels up and down on one of the stationary tines of the dish drain basket.
Figure 6:
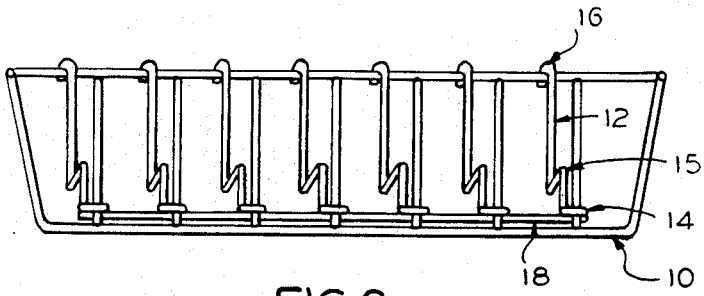
FIG. 6 is a level view from inside the drain basket looking out, with the extendable side in the retracted position.
Figure 7:
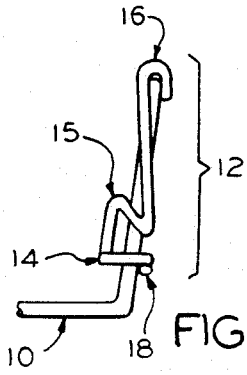
FIG. 7 is a perspective view of one of the end tines of an extendable side in the retracted position. This view also shows the function of the upper hook configuration that is used to lock the extendable side in the down position.

The extendable and retractable side 20 as shown in FIG. 3 is comprised of a plurality of tines 12 and a bottom connecting rod 18 which as shown in FIGS. 5 and 7 is positioned on the outside of the basket 10 and acts to join together the plurality of tines 12 and also to aid in stabilizing the tines 12 when in the extended position.

FIG. 3 shows that each tine 12 is attached to a loop configuration 14 and to the connecting rod 18. This can be accomplished by suitable means such as welding. As shown in FIGS. 5 and 7 the function of the loops 14 are to attach the extendable sides 20 to the sides of the dish drain basket 10 by encircling the fixed tines of the drain basket 10 and using these fixed tines as guide-posts on which the extendable and retractable sides 20 are raised and lowered.

FIG. 5 shows that each tine 12 has a hook configuration 15 in its lower position. These lower hook configurations 15 are used to secure the sides 20 in the extended position for placement of cups and glasses.

FIG. 7 shows that each tine 12 also has a hook configuration 16 in its upper portion. These upper hook configuration 16 are used to secure the sides 20 in their retracted position when they're not needed for their extra storage capacity.

I claim:

1. A standard type dish drain basket comprising:

a plurality of fixed tines, at least one extendable and retractable side, said at least one side is constructed with a plurality of movable tines for the storage of cups and glasses for draining, each of said movable tines having an upper and lower end, said movable tines lower ends are formed into a lower hook configuration for securing the side to said standard dish drain basket in the extended position and an upper hook configuration for securing the side to said standard dish drain basket in the retracted position, said movable tines also have a loop configuration at their lower end that is used to encircle the fixed tines of the standard dish drain basket and use these fixed tines as guide-posts on which to raise and lower the sides, to their extended and retracted positions, respectively said tines are joined together at said loop configuration by a bottom connecting rod which stabilizes the entire side.

2. The dish drain basket as defined by claim 1 wherein the standard dish drain basket has been adapted for accommodating four contiguous, but independently extendable and retractable sides.

* * * * *